US005269393A

United States Patent [19]

Luscombe

[11] Patent Number: 5,269,393

[45] Date of Patent: Dec. 14, 1993

[54] BRAKE MECHANISM FOR A BOOM SUPPORTED OCCUPANT BUCKET

[75] Inventor: Terry L. Luscombe, Armstrong, Iowa

[73] Assignee: T.G. Industries Inc., Armstrong, Iowa

[21] Appl. No.: 51,198

[22] Filed: Apr. 22, 1993

[51] Int. Cl.[5] ..... B66F 11/04

[52] U.S. Cl. ..... 182/2; 188/72.7

[58] Field of Search ..... 182/2, 141, 63; 188/72.7, 72.8, 72.9

[56] References Cited

U.S. PATENT DOCUMENTS 3,463,274 8/1969 Hollnagel ..... 188/72.7
3,605,941 9/1971 Edwards ..... 182/2
3,695,390 10/1972 Leigh ..... 182/129
3,853,206 12/1974 Kibler et al. ..... 188/72.9

*Primary Examiner*—Alvin C. Chin-Shue
*Attorney, Agent, or Firm*—Herman H. Bains

[57] ABSTRACT

A vehicle mounted lift apparatus includes a boom having an L-shaped support arm pivotally suspended from the outer end thereof. An occupant supporting bucket is pivotally mounted on the L-shaped arm for rotation about a vertical axis. A brake mechanism is mounted on the L-shaped arm and occupant supporting bucket below the bottom wall of the bucket for locking the bucket against rotation. A brake actuating mechanism is provided for releasing the brake from a normally locked position.

6 Claims, 2 Drawing Sheets

BRAKE MECHANISM FOR A BOOM SUPPORTED OCCUPANT BUCKET

FIELD OF THE INVENTION

This invention relates to boom-supported occupant buckets and more specifically to a brake device for an occupant bucket.

BACKGROUND OF THE INVENTION

Many types of vehicle mounted lift apparatus are used for general utility and include a bucket for supporting an occupant therein. The lift apparatus is usually mounted on a truck and is typically used in the maintenance of electrical utility systems, window washing, fruit picking and for similar purposes. The occupant supporting bucket is mounted on a boom, and some buckets are also mounted for rotation about a vertical axis. It is desirable to lock or brake the bucket in a selected rotational position.

Certain locking devices have been developed for boom apparatus having occupant supported chairs or buckets. For example, U.S. Pat. No. 4,195,708 discloses a mechanical latch device for locking an aerial chair in a predetermined position.

U.S. Pat. No. 4,784,278 discloses a mechanical lock device for locking a bucket in a selected position.

U.S. Pat. No. 4,365,926 discloses a brake device for latching a free hanging fork lift in a selected position. The fork lift implement does not pivot about a vertical pivot.

However none of the references disclose the use of a revolvable occupant supporting bucket having a brake type device for locking the bucket in a selected adjusted position.

SUMMARY OF THE INVENTION

It is an object of this invention to provide a novel brake device for a revolvable, boom-mounted, occupant supporting bucket for locking the bucket in a selected position. Specifically, the occupant supporting bucket is supported on an L-shaped arm which is pivoted to the end of a boom for swinging movement about a transverse horizontal axis. A brake disk is secured to the bucket below its bottom wall and is revolvable therewith. Disk engaging clamping pads are mounted on the L-shaped arm and are shiftable between clamping and release positions by an actuating mechanism. A helical spring normally urges the clamping pads into clamping relation with the disk, and an actuating handle permits an operator to shift the brake mechanism to the release position to allow rotation of the bucket.

DESCRIPTION OF THE PREFERRED EMBODIMENT

Figure 1:
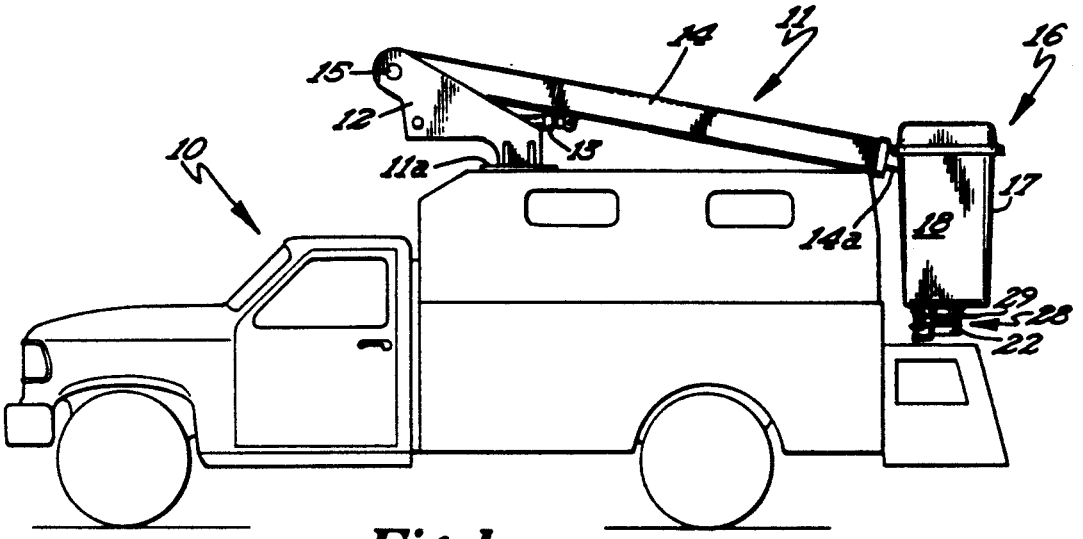
FIG. 1 is an elevational view illustrating a vehicle and lift apparatus mounted thereon.

Referring now to the drawings and more specifically to FIG. 1, it will be seen that a vehicle 10 is thereshown having the lift apparatus 11 mounted thereon. The lift apparatus includes a base 12 which is rotatably mounted on vehicle 10 in a well-known manner, and having the lower end of an elongate boom arm 14 pivotally connect hereto by a pivot 15. The boom arm is also of telescopic sectional construction includes an outer section 14*a*. A generally rectangular shaped occupant supporting bucket 16 is pivotally mounted on the outer end of the outer 14*a* section of the boom arm 14. The base 12 is revolvable about a vertical axis, and the boom arm 14 is vertically swingable about the pivot 15 in response to extension and retraction of the hydraulic ram 13. The hydraulic ram 13 extends between and is pivotally connected to the boom arm 14 and base 12.

The occupant supporting bucket 16 is formed of fiberglass reinforced plastic and includes opposed side walls 17, opposed end walls 18, and a bottom wall 19. In the embodiment shown, the outer end of the outer section 14*a* of boom arm 14 is provided with an L-shaped support arm 20 which is pivotally connected thereto for swinging movement about a horizontal pivot 23. The L-shaped support arm includes a vertical arm portion 21 and a horizontal arm portion 22. It will be noted that the upper end of the vertical arm portion 21 is pivotally connected to the outer section 14*a* of the boom arm by pivot 23 so that the arm is freely suspended from the boom. Thus the L-shaped support arm will hang vertically regardless of the angular disposition of the boom arm 14.

The bottom wall 19 of the occupant supported bucket 16 is provided with a centrally located downwardly extending, inverted frustro-conical projection 24 which is of hollow construction and which receives the upper portion of a vertical frustro-conical post 25 therein. The post 25 is rigidly secured to the horizontal arm portion 22 of the L-shaped support arm 20. A collar 26 is mounted on the horizontal arm portion and extends around the post 25 and the latter projects into the projection 24. One or more cone bearings 27 are interposed between the post and inner surface of the downwardly extending projection 24 to permit rotation of the bucket about a vertical axis defined by the post 25. The vertical rotational axis for the bucket is located below the general plane of the bottom wall.

The operator, while standing in the bucket, may manually rotate the bucket about its vertical axis to a selected position. Means are provided for retaining the bucket in the adjusted angular position and this means includes a normally locked brake mechanism 28. The brake mechanism 28 includes a generally circular horizontally disposed brake disk 29 which is rigidly secured to the lower end portions of the downwardly extending projection 24 of the bucket 16 by suitable bolts 30. The brake mechanism also includes a base plate 31 which is rigidly secured to the upper surface 31 of the horizontal arm portion 22 by welding or the like. The brake mechanism 28 further includes a lower brake pad carrier 32 formed of a rigid material and having a lower brake pad 33 secured to the upper surface thereof.

An upper brake pad carrier 34 is positioned above the lower brake pad 33 and has an upper brake pad 35 secured to the lower surface thereof for movement therewith. It will be noted that the upper and lower plate pads are normally disposed in engaging relation with opposite surfaces of the brake disk 29. A pair of elongate headed bolts 36 extends through the brake disk, the base plate 31, the upper and lower brake pad carriers and the upper and lower brake pads. Suitable nut assemblies 37 locks the bolt 36 to the base plate 31. A pair of helical springs 38 are each positioned around a bolt and extends through openings in the brake pads and the disk 29 and bear against the brake pad carriers to urge the brake pad carriers apart.

An actuating mechanism is provided for shifting the brake pads into and out of clamping relation with the disk 29. This actuating mechanism includes an L-shaped bracket 40 including a horizontal arm 41 which is rigidly secured to the horizontal portion 22 of the L-shaped arm 20. A lower clamp unit 42 is secured to the horizontal arm 41 of the L-shaped bracket 40 and clamps the lower end of an elongate cable sheath 43 in fixed relation with respect to the L-shaped bracket. The upper end of the cable sheath is secured against movement with respect to the vertical arm portion 21 of the L-shaped arm 20 by means of an upper clamping unit 44. The upper clamping unit 44 is secured to the upper end of the vertical arm portion 21.

An elongate cable 45 extends through the cable sheath 43, and the upper end of the cable is secured to an upper cable clevis 46. One end of an elongate actuating handle 48 pivotally connected to the upper cable clevis 46 by means of a pivot 47. The handle 48 is pivotally connected intermediate its ends to a bracket 50 which is secured to the upper end of the vertical portion of the L-shaped arm 20.

Figure 3:
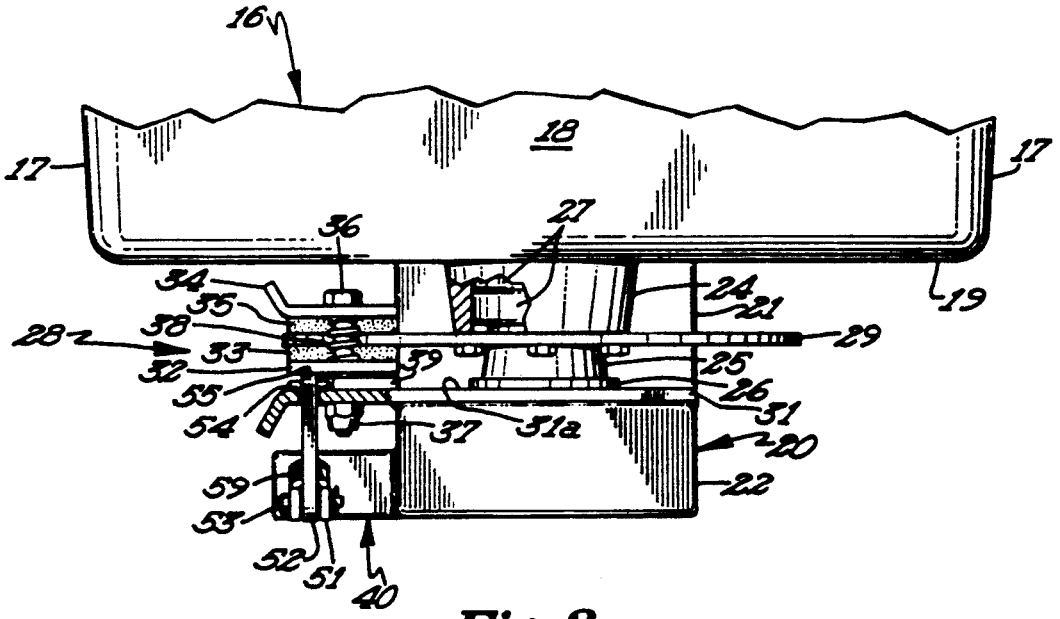
FIG. 3 is a cross-sectional view taken approximately along line 3—3 of FIG. 2 and looking in the direction of the arrows.
Figure 2:
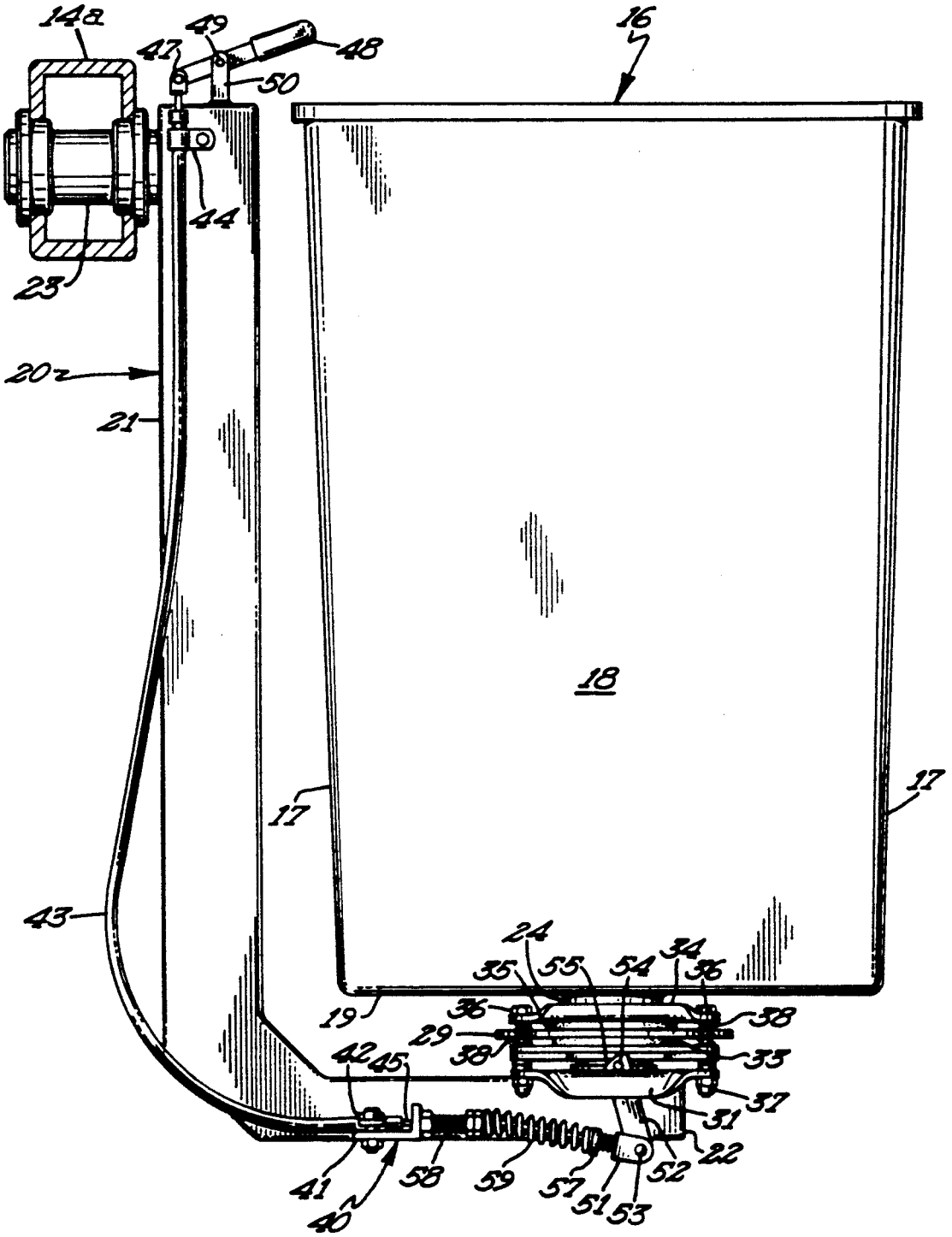
FIG. 2 is an enlarged cross-sectional view of the apparatus illustrating details of construction of the occupant supporting bucket and the brake mechanism.

The lower end of the cable 45 is secured to a lower cable clevis 51 which is pivotally connected to the lower end of a cam arm or lever 52 by a lower pivot 53. The upper end portion of the cam arm 52 is provided with a rock element 54 which extends outwardly from opposite sides thereof and which engages the upper surface of the base plate 31, as best seen in FIGS. 2 and 3. The rock element 54 serves as a pivot for the upper end portion of the cam arm 52. In this regard, it will be noted that the cam arm 52 projects through a slot in the base plate and terminates in a curved upper cam surface 55 having high and low end portions. It will be noted that when the cam arm 52 is in the position illustrated in FIG. 2, the cam arm will urge the brake pads into tight clamping relation with respect to the brake disk 29 thereby preventing rotation of the bucket. Movement of the handle 48 shifts the cam arm 52 between the clamping and release positions.

Means are provided for normally urging the cam arm 52 to the locked or clamping position illustrated in FIG. 2, and this means includes a heavy helical spring 59 positioned around the cable 45. One end of the spring 59 bears against a collar 56 secured to the lower end of the cable 45. The other end of the spring 59 bears against one of a plurality of spacer elements 58 also positioned on the cable.

It will be seen that the heavy helical spring 59 normally urges the brake pads via the cam arm 52 to the braking or locked position. In this regard, the resilient action (energy) of the heavy spring 59 overwhelms the counter action of the lighter springs 38. When a user wishes to angularly adjust the bucket about its vertical pivot axis, the user or operator will simply grasp the handle 48 and shift the handle about the pivot 47 to pull the cable 45 in an upward direction. This shifts the cam arm 52 so that the lower surface of the lower brake carrier follows cam surface 55 from the high side to the low side. The light helical springs 38 urge the brake pads away from the brake disk and permit the operator to manually rotate the bucket about its vertical axis. Typically, the operator will simply grasp the upper boom arm 14 after the brake is unlocked to facilitate rotational movement of the bucket. Once the selected position has been reached, the operator or user will release the lever 58 which in turn releases the helical spring 59 to allow the latter to shift from the compressed to the released position and shift the cam arm 52 to the position illustrated in FIG. 2 thereby compressing the brake pads against the disk. Thus the brake is normally locked to prevent rotational movement of the bucket and rotation is permitted only upon the release of the brake mechanism.

It will therefore be seen that I have provided a novel brake mechanism for a lift apparatus which normally locks the occupant supporting bucket against rotational movement, but which is readily releasable to permit angular adjustment of the bucket.

What is claimed is:

1. A vehicle mounted lift apparatus including a base, an elongate boom having one end thereof connected to said base, power means for pivotally swinging said boom between lowered and elevated positions, a support arm pivotally connected to the other end of said boom for pivoting movement relative thereto about a horizontal axis, an occupant support bucket for supporting an occupant therein, said bucket having upstanding vertical walls and a bottom wall, means rotatably mounting the bucket on the support arm to permit rotation of the bucket about a vertical axis, a brake mechanism positioned below the general plane of the bottom wall of said bucket including a disk secured to the bucket for rotation therewith, disk engaging means mounted on said support arm and being shiftable between a disk clamping and release positions, said disk engaging means clamping said disk and bucket against rotational movement when in the clamping position, and disengaging said disk when in the release position to permit rotation of the bucket, an actuating mechanism for shifting said disk clamping means between release and clamping positions including a shiftable cam element engaging said disk engaging means, and yieldable means for normally urging said cam element to the clamping position.

2. A lift apparatus mounted on a vehicle and including a angular adjustable base revolvable about a vertical axis, an elongate boom having one end thereof connected to said base, power means for pivotally swinging said boom between lowered and elevated positions, an L-shaped support arm pivotally connected to the other end of said boom for pivoting movement relative thereto about a horizontal axis, and including a vertical arm position and a horizontal arm position, an occupant support bucket for supporting an occupant therein, said bucket having upstanding vertical walls and a bottom wall, means rotatably mounting the bucket on the horizontal arm position of the support arm to permit rotation of the bucket about a vertical axis, a brake mechanism positioned below the general plane of the bottom wall said bucket including a disk secured to the bucket for rotation therewith, disk engaging means mounted on said support arm and being shiftable between a disk clamping and release positions, said disk engaging means clamping said disk and bucket against rotational movement when in the clamping position, and disengaging said disk when in the release position to permit rotation of the bucket, an actuating mechanism for shifting said disk clamping means between release and clamping positions including a shiftable cam element engaging said disk engaging means, and yieldable means for normally urging said cam element to the clamping position.

3. The apparatus as defined in claim 2 wherein said disk engaging means comprises a pair of brake pads engaging and clamping opposite surfaces of said disk when in the clamping position.

4. The apparatus as defined in claim 2 wherein said actuating mechanism includes an elongate cable connected to said cam element.

5. The apparatus as defined in clam 4 wherein said yieldable means comprises a helical spring positioned around said cable.

6. The apparatus as defined in claim 3 and resilient means engaging said brake to urge the brake pads out of engaging relation when said actuating mechanism shifts said brake mechanism to the release position.

* * * * *